US005080074A

United States Patent [19]

Tsukamoto et al.

[11] Patent Number: 5,080,074

[45] Date of Patent: Jan. 14, 1992

[54] AIR-FUEL RATIO CONTROL DEVICE OF AN INTERNAL COMBUSTION ENGINE

[75] Inventors: Keisuke Tsukamoto; Toshio Takaoka; Takao Fukuma; Hirofumi Yamasaki, all of Toyota, Japan

[73] Assignee: Toyota Jidosha Kabushiki Kaisha, Toyota, Japan

[21] Appl. No.: 643,767

[22] Filed: Jan. 22, 1991

[30] Foreign Application Priority Data

Jan. 31, 1990 [JP] Japan ..... 2-18972

[51] Int. Cl.[5] ..... F02D 41/02; F02D 41/12

[52] U.S. Cl. ..... 123/492; 123/493

[58] Field of Search ..... 123/478, 492, 493

[56] References Cited

U.S. PATENT DOCUMENTS 4,528,956 7/1985 Ogata et al. ..... 123/440
4,616,619 10/1986 Saito et al. ..... 123/492 X
4,644,923 2/1987 Morita et al. ..... 123/493

FOREIGN PATENT DOCUMENTS 60-13936 1/1985 Japan .
63-129140 6/1988 Japan .
1-187338 7/1989 Japan .

*Primary Examiner*—Tony M. Argenbright
*Attorney, Agent, or Firm*—Kenyon & Kenyon

[57] ABSTRACT

An air-fuel ratio control device comprising a memory which stores the relationship between the degree of opening of the throttle valve and the absolute pressure in the intake passage, which pressure is produced when the engine is in a cruising state. When a difference between the blunt value of the actual absolute pressure in the intake passage and the absolute pressure stored in the memory exceeds a fixed value, the air-fuel mixture is changed from the mixture for the stoichiometric air-fuel ratio to a lean mixture.

6 Claims, 5 Drawing Sheets

AIR-FUEL RATIO CONTROL DEVICE OF AN INTERNAL COMBUSTION ENGINE

BACKGROUND OF THE INVENTION

1. Field of the Invention

The present invention relates to an air-fuel ratio control device of an internal combustion engine.

2. Description of the Related Art

In known engines, when the engine is in the cruising state, the air-fuel mixture is made lean, and when the engine is accelerated, the air-fuel ratio is brought to the stoichiometric air-fuel ratio. When the cruising state of the engine is started after the engine has been accelerated, the air-fuel mixture is made lean again (Japanese Unexamined Patent Publication Nos. 60-13936 and 63-129140). In the engine disclosed in Japanese Unexamined Patent Publication No. 60-13936, when a rate of change in the degree of opening of the throttle valve becomes smaller than a fixed negative value after the acceleration of the engine is completed, the air-fuel mixture is changed from that for the stoichiometric air-fuel ratio to that for a lean mixture. In the engine disclosed in Japanese Unexamined Patent Publication No. 63-129140, when a rate of change in the pressure in the intake passage becomes smaller than a fixed negative value after the acceleration of the engine is completed, the air-fuel mixture is changed from that for the stoichiometric air-fuel ratio to that for a lean mixture.

The output torque of an engine operated by using the lean air-fuel mixture is much smaller than that where the engine is operated by using the mixture for the stoichiometric air-fuel ratio, and therefore, when the air-fuel mixture is changed from the mixture for the stoichiometric air-fuel ratio to the lean mixture after the acceleration of the engine is completed, the output torque of the engine is abruptly lowered. In addition, when the operating state of the engine is changed from the acceleration state to the cruising state, since the throttle valve is slightly closed, the amount of air fed into the engine cylinders is reduced, and thus a decelerating force acts on the vehicle. If the air-fuel mixture is changed from the mixture for the stoichiometric air-fuel ratio to the lean air-fuel mixture when the amount of air fed into the engine cylinders is reduced as mentioned above, the reduction in the output torque of the engine is superimposed on the decelerating force due to the reduction in the amount of air fed into the engine cylinders, and thus there is no danger that the driver will be made uncomfortable by an abrupt reduction in the output torque. Nevertheless, in the above-mentioned known engines, since it is impossible to successfully detect only the change from the acceleration state to the cruising state, or since a time at which the decelerating force due to the reduction in the amount of air fed into the engine cylinders occurs deviates from a time at which the reduction in the output torque of the engine occurs, even if the change from the acceleration state to the cruising state can be successfully detected, the driver will be made uncomfortable by an abrupt reduction in the output torque.

Next, this phenomenon will be described with reference to FIG. 6.

FIG. 6 illustrates the state wherein the degree of opening TA of the throttle valve is slightly reduced when the acceleration of the engine is completed. When a short time has elapsed after a reduction in the degree of opening TA of the throttle valve has begun, a reduction in the amount of air fed into the engine cylinders is begun, and as a result, the acceleration G becomes negative, i.e., a decelerating force acts on the vehicle. In FIG. 6, the solid line illustrates the case wherein the air-fuel mixture is changed from the mixture for the stoichiometric air-fuel ratio to the lean mixture when a ratio of change ΔTA of the degree of opening TA of the throttle valve becomes smaller than a fixed negative valve TAO, as disclosed in Japanese Unexamined Patent Publication No. 60-13936, a one-dot and dash line illustrates the case wherein the air-fuel mixture is changed from the mixture for the stoichiometric air-fuel ratio to the lean mixture when a ratio of change ΔPM of the pressure PM in the intake passage becomes smaller than a fixed negative value PMO, as disclosed in Japanese Unexamined Patent Publication No. 63-129140. Nevertheless, since the rate of change ΔTA of the degree of opening TA of the throttle valve and the rate of change ΔPM of the pressure PM is small, it is difficult to correctly detect that the ΔTA has become smaller than the fixed value TAO or that the ΔPM has become smaller than the fixed value PMO. As a result, a problem arises in that, when the operating state of the engine is changed from the acceleration state to the cruising state, the air-fuel mixture will not be changed from the mixture for the stoichiometric air-fuel ratio to the lean mixture, and thus the engine will continue to be operated while using the mixture for the stoichiometric air-fuel ratio. Further, if the air-fuel mixture is changed from the mixture for the stoichiometric air-fuel ratio to the lean mixture when the ΔTA becomes smaller than TAO or when the ΔPM becomes smaller than PMO, since the ΔTA has become smaller than TAO before a reduction of the amount of air Q fed into the engine cylinders is begun, the decelerating force $G_1$ due to the reduction in the output torque of the engine occurs before the decelerating force $G_0$ due to the reduction in the amount of air Q occurs, and since the ΔPM becomes smaller than PMO after the reduction of the amount of air Q is begun, the decelerating force $G_2$ due to the reduction in the output torque of the engine occurs after the decelerating force $G_0$ due to the reduction in the amount of air Q occurs. In this case, since the decelerating force $G_0$ due to the reduction of the amount of air Q occurs based on an operation by the driver, the occurrence of the decelerating force $G_0$ will not make the driver feel uncomfortable. Nevertheless, since the decelerating force $G_1$ or $G_2$ due to the reduction in the output torque of the engine does not occur based on the operation by the driver, the occurrence of the decelerating force $G_1$ or $G_2$ will make the driver feel uncomfortable. Furthermore, since a considerable change occurs in the pressure PM when the engine is rotating, a drawback occurs in that the ΔPM becomes smaller than the fixed value PMO even though the operating state of the engine has not changed.

In FIG. 6, the broken line illustrates the case wherein the change in the pressure PM in the intake passage is blunted, and the air-fuel mixture is changed from the mixture for the stoichiometric air-fuel ratio to the lean mixture when a rate of change ΔPMA of this blunted value PMA of the pressure PM becomes smaller than a fixed negative value PMAO. In this case, since a large amount of change occurs in the ΔPMA, it is possible to correctly detect the change from the acceleration state to the cruising state. Nevertheless, since the blunt value PMA is not changed until a short time after the pressure PM is changed, the decelerating force $G_3$ due to the reduction of the output torque of the engine occurs a short time after the decelerating force $G_0$ due to the reduction in the amount of air Q occurs. Consequently, in all of the examples illustrated in FIG. 6, a problem arises in that the driver is made uncomfortable when the operating state of the engine is changed from the acceleration state to the cruising state.

SUMMARY OF THE INVENTION

An object of the present invention is to provide an air-fuel ratio control device capable of ensuring that the driver is not made uncomfortable when the operating state of the engine is changed from the acceleration state to the cruising state.

According to the present invention, there is provided an air-fuel ratio control device of an engine having an intake passage provided with a throttle valve therein, the device comprising: a first detecting means for detecting the degree of opening of the throttle valve; a second detecting means for detecting an actual absolute pressure in the intake passage downstream of the throttle valve; a memory means for storing a reference absolute pressure in the intake passage downstream of the throttle valve, the reference absolute pressure indicating a pressure produced when the engine is placed in the cruising state and being a function of the degree of opening of the throttle valve; a blunting means for calculating a blunt value of the actual absolute pressure; and a control means for controlling an air-fuel mixture fed to the engine in response to the degree of opening of the throttle valve, to make the air-fuel mixture leaner when the blunt value of the actual absolute pressure becomes larger by a fixed value than the reference absolute pressure determined by the degree of opening of the throttle valve.

The present invention may be more fully understood from the description of a preferred embodiment of the invention set forth below, together with the accompanying drawings.

DESCRIPTION OF A PREFERRED EMBODIMENT

Figure 1:
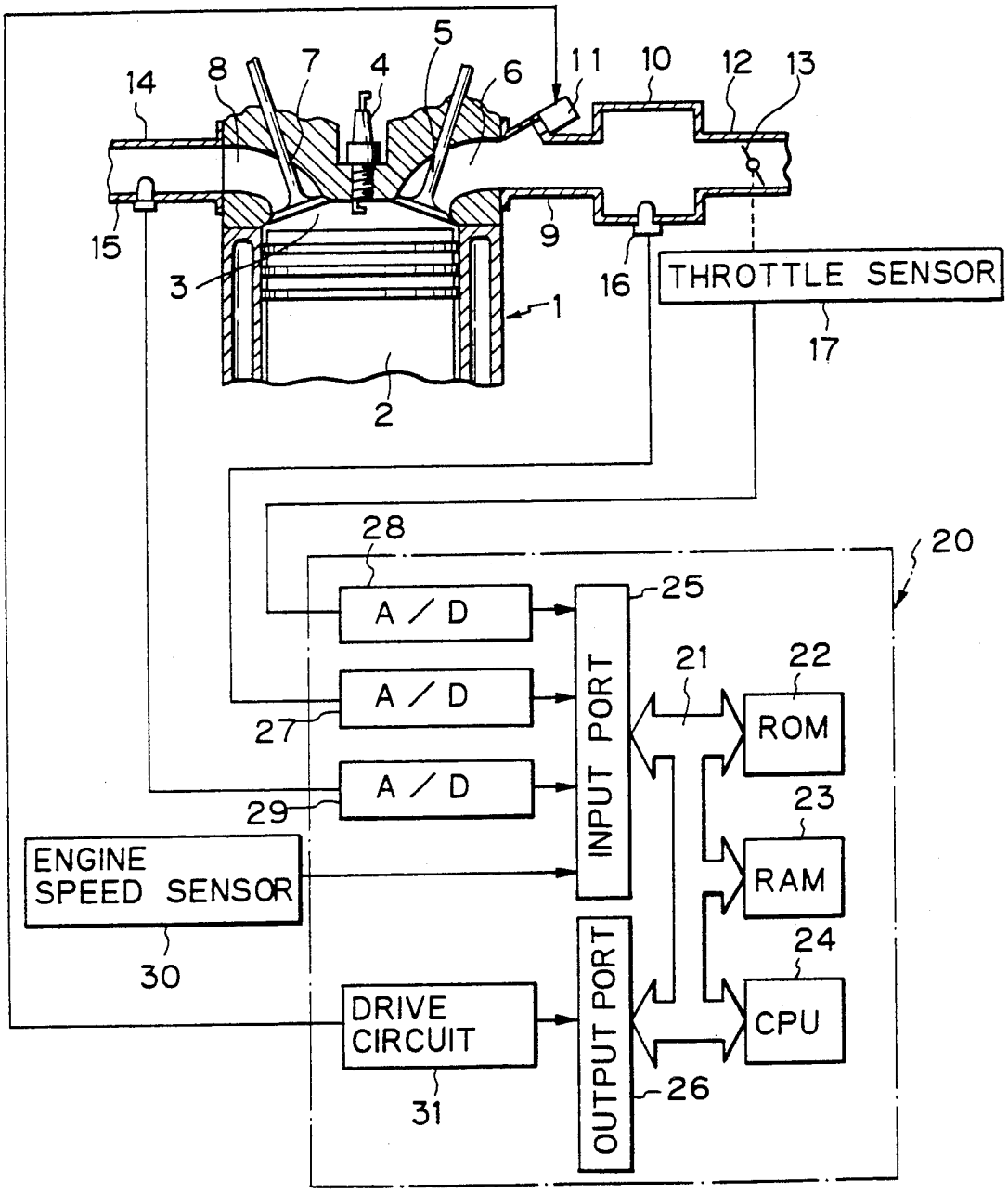
FIG. 1 is a general view of an engine.

Referring to FIG. 1, reference numeral 1 designates an engine body, 2 a piston, 3 a combustion chamber, and 4 a spark plug; 5 designates an intake valve, 6 an intake port, 7 an exhaust valve, and 8 an exhaust port. The intake port 6 is connected to a surge tank 10 via a corresponding branch pipe 9, and a fuel injector 11 for injecting fuel toward the corresponding intake port 6 is mounted on the branch pipe 9. The igniting operation by the spark 4 and the injecting operation of fuel by the fuel injector 11 are controlled by signals output from an electronic control unit 20. The surge tank 10 is connected to the air cleaner (not shown) via an intake duct 12, and a throttle valve 13 is arranged in the intake duct 12. The exhaust port 8 is connected to an exhaust manifold 14, and an oxygen concentration detector (hereinafter referred to as an $O_2$ sensor) 15 capable of detecting both the stoichiometric air-fuel ratio and the lean air-fuel ratio is arranged in the exhaust manifold 14.

The electronic control unit 20 is constructed as a digital computer and comprises a ROM (read only memory) 22, a RAM (random access memory) 23, a CPU (microprocessor, etc.) 24, an input port 25 and an output port 26. The ROM 22, the RAM 23, the CPU 24, the input port 25 and the output port 26 are interconnected by a bidirectional bus 21. A pressure sensor 16 producing an output voltage proportional to the absolute pressure in the surge tank 10 is arranged in the surge tank 10, and the output voltage of the pressure sensor 16 is input to the input port 25 via an AD converter 27. A throttle sensor 17 producing an output voltage proportional to the degree of opening of the throttle valve 13 is connected to the throttle valve 13, and the output voltage of the throttle sensor 17 is input to the input port 25 via an AD converter 28. The $O_2$ sensor 15 produces an output signal representing the concentration of oxygen in the exhaust gas, and this output signal is input to the input port 21 via an AD converter 29. The air-fuel ratio of mixture is determined from the signal output by the AD converter 29. In addition, an engine speed sensor 30 producing an output signal which represents the engine speed NE is connected to the input port 25. The output port 26 is connected to the fuel injector 11 via a drive circuit 31.

Next, an embodiment of an air-fuel ratio control according to the present invention will be described with reference to FIGS. 2 through 5.

Figure 2:
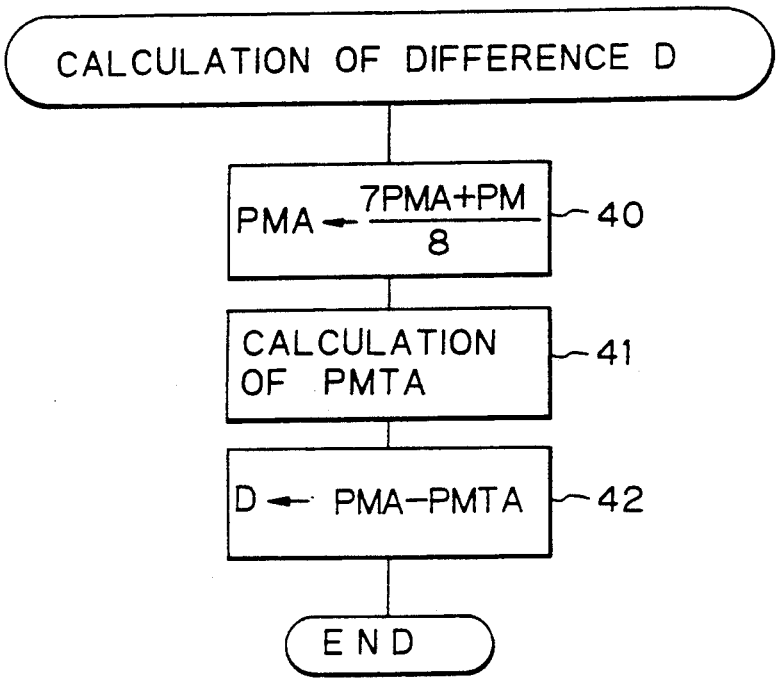
FIG. 2 is a flow chart for calculating a difference between the actual absolute pressure and the stored absolute pressure.

FIG. 2 illustrates a routine for calculating a difference D between the blunt value of the absolute pressure PM in the intake passage and the pressure PMTA stored in the memory means. This routine is processed by sequential interruptions executed at predetermined intervals, for example, every 8 msec.

Referring to FIG. 2, in step 40 the blunt value PMA of the absolute pressure PM in the surge tank 10 is calculated based on the following equation.

$$PMA = (7PMA + PM)/8$$

Where, PMA in the bracket indicates the blunt value which was calculated in the previous processing cycle, and PM indicates the current absolute pressure detected by the pressure sensor 16.

Figure 3:
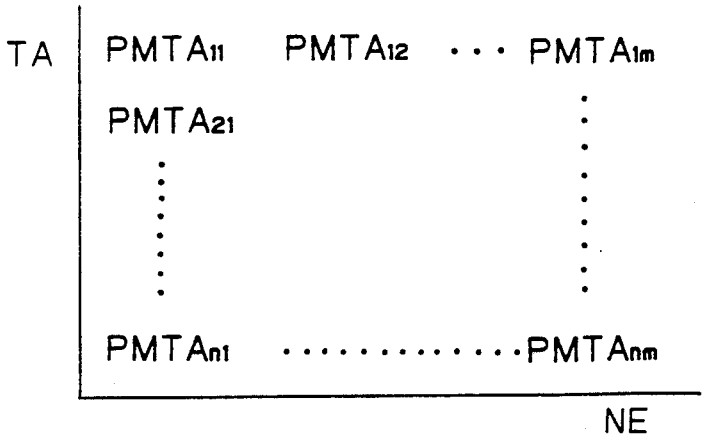
FIG. 3 is a diagram of the absolute pressure stored in the map.

Next, in step 41, the absolute pressure PMTA in the surge tank 10 while the engine is in the cruising state is calculated on the basis of the degree of opening TA of the throttle valve 13, which is detected by the throttle sensor 17, and the engine speed NE detected by the engine speed sensor 30. This absolute pressure PMTA while the engine is in the cruising state is experimentally obtained in advance, and the absolute pressures PMTA obtained by experiments are stored in the ROM 22 in advance as a function of the degree of opening TA of the throttle valve 13 and the engine speed NE as illustrated in FIG. 3. Then, in step 42, the difference D between the blunt value PMA and the absolute pressure PMTA while the engine is in the cruising state is calculated by subtracting PMTA from PMA.

Next, changes in the PMA, PMTA, and D will be described with reference to the time chart illustrated in FIG. 5.

Figure 5:
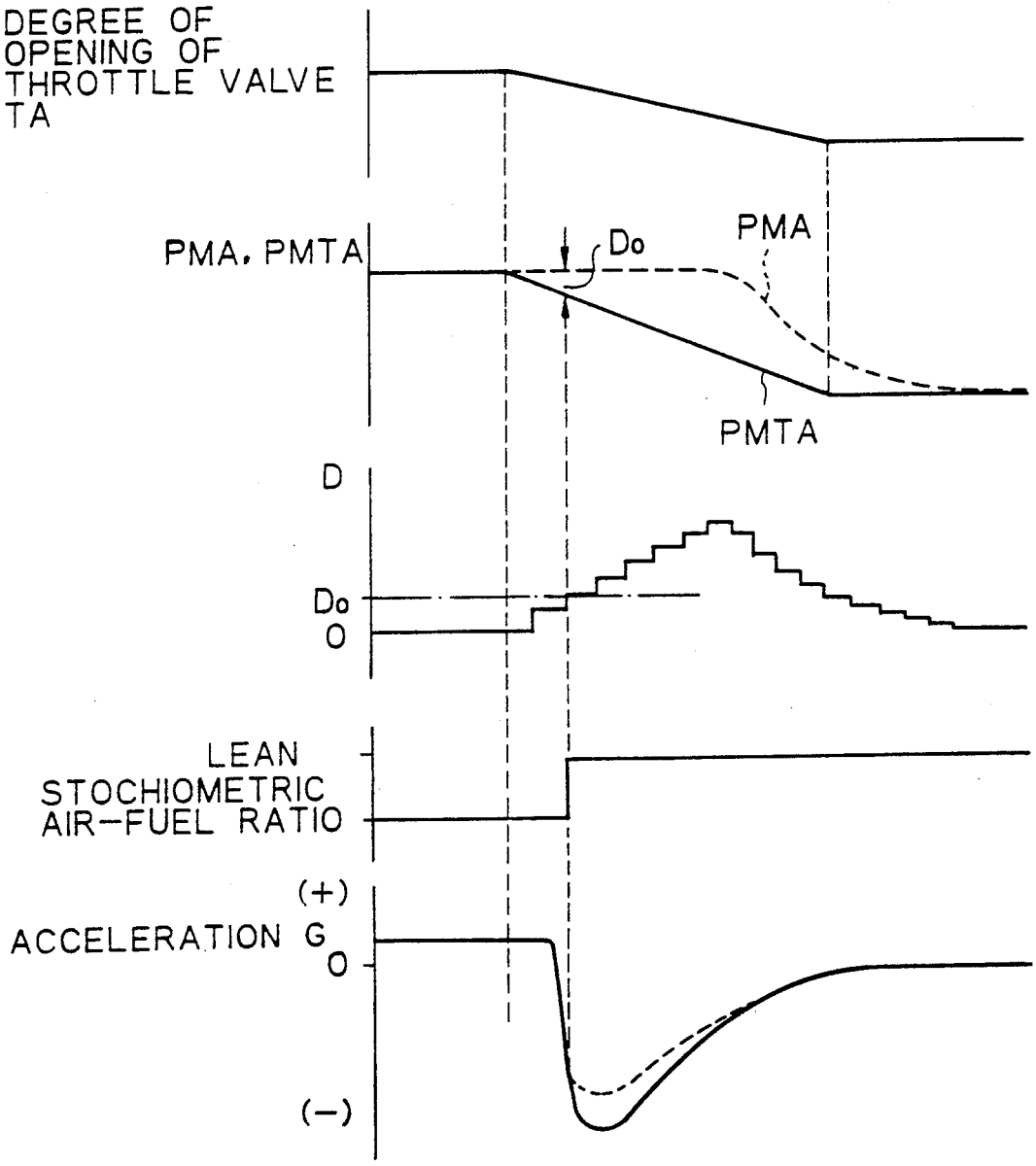
FIG. 5 is a time chart of a control routine according to the present invention.

FIG. 5 illustrates the change of the operating state of the engine from the acceleration state to the cruising state, in the same manner as FIG. 7, and at this time, the degree of opening TA of the throttle valve is slightly reduced. As illustrated in FIG. 5, even if the degree of opening TA of the throttle valve is reduced, and a drop occurs in the absolute pressure PM in the surge tank 10, the blunt value PMA of the absolute pressure PM in the surge tank 10 is not immediately lowered but is maintained at an approximately constant value for a short time after the reduction of the degree of opening TA of the throttle valve has begun. Conversely, since the absolute pressure PMTA during the cruising state is a function of the degree of opening TA of the throttle valve, a drop in the absolute pressure PMTA begins as soon as a reduction in the degree of opening TA of the throttle valve is begun.

Figure 6:
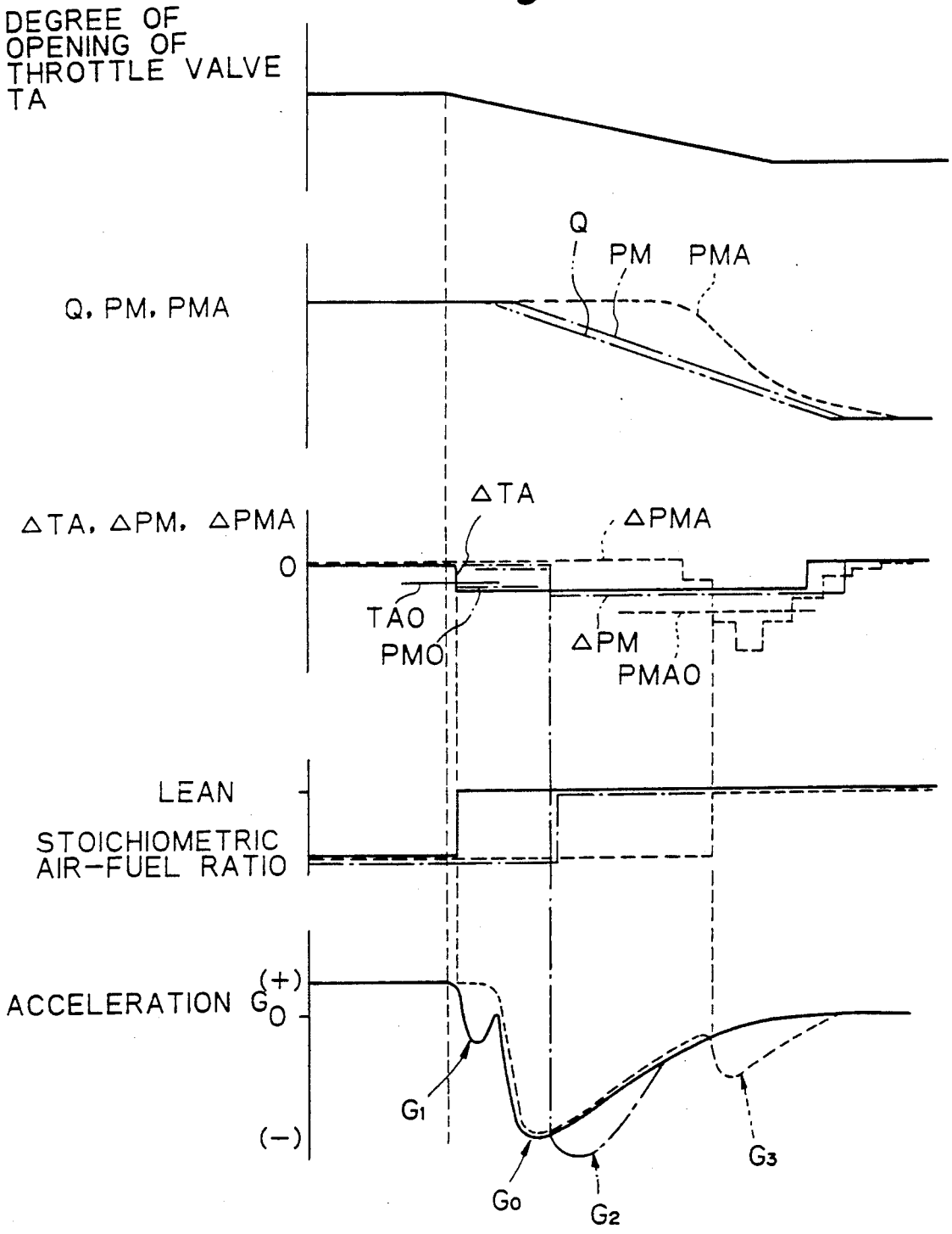
FIG. 6 is a time chart of a control routine of the related art.

As mentioned above with reference to FIG. 6, a short time after the reduction of the degree of opening TA of the throttle valve has begun, the amount of air Q is reduced, and the decelerating force acts on the vehicle as illustrated by the broken line in the acceleration G portion shown in FIG. 5. At this time, if the air-fuel mixture is changed from the mixture for the stoichiometric air-fuel ratio to the lean mixture, immediately before the deceleration (−G) reaches a maximum value, the decelerating force due to the reduction in the output torque of the engine is superimposed on the decelerating force due to the reduction in the amount of air Q, and as a result, there is no danger that the driver will be made to feel uncomfortable. Therefore, in the embodiment according to the present invention, the difference D during the time between a time at which the reduction of the amount of air Q is begun, and accordingly, the deceleration (−G) begins to increase, and a time at which the deceleration (−G) reaches the maximum value, is determined as a fixed value $D_0$ in advance, and when the difference D is greater than $D_0$, the air-fuel mixture is changed from the mixture for the stoichiometric air-fuel ratio to the lean mixture.

Next, the main routine will be described with reference to FIG. 4.

Figure 4:
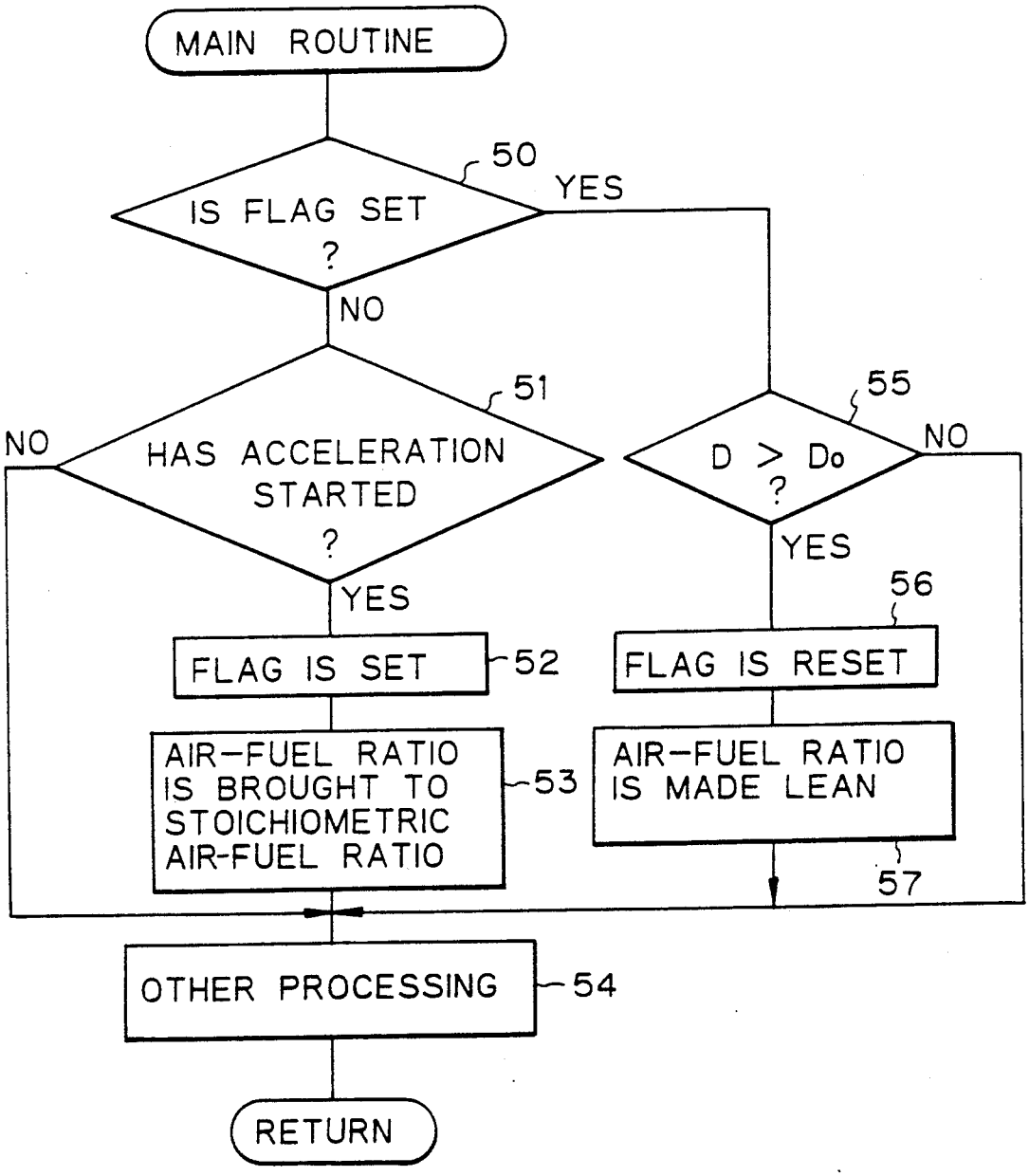
FIG. 4 is a flow chart illustrating a main routine.

Referring to FIG. 4, in step 50 it is determined whether or not a flag, which is set when the acceleration of the engine is started, is set. When the flag is reset, the routine goes to step 51, and it is determined from, for example, a change in the degree of opening TA of the throttle valve, whether or not the acceleration of the engine has started. When the acceleration of the engine has started, the routine goes to step 52 and the flag is set. Then, in step 53, the process for controlling the air-fuel ratio on the basis of the output signal of the $O_2$ sensor 15, so that the air-fuel ratio becomes equal to the stoichiometric air-fuel ratio after this time, is carried out, and then in step 54 the other processing is carried out. Consequently, once the acceleration of the engine is started, the air-fuel mixture is maintained thereafter at the stoichiometric air-fuel ratio.

When the acceleration of the engine has started, and the flag is set, the routine goes from step 50 to step 55, and it is determined whether or not the difference D has become larger than the fixed value $D_0$. When D has become larger than $D_0$, the routine goes to step 56 and the flag is reset. Then, in step 57, the process for controlling the air-fuel mixture on the basis of the output signal of the $O_2$ sensor 15, so that the air-fuel mixture becomes lean after this time, is carried out.

According to the present invention, since the difference between the stored pressure and the blunt value becomes very large when the operating state of the engine is changed from the acceleration state to the cruising state, it is possible to correctly detect the change from the acceleration state to the cruising state. In addition, since this difference immediately increases when the reduction of the degree of opening of the throttle valve is begun, it is possible to make the air-fuel mixture leaner when the reduction of the amount of air fed to the engine cylinder is begun, by comparing the difference and the fixed value.

Although the invention has been described with reference to a specific embodiment chosen for purposes of illustration, it should be apparent that numerous modifications could be made thereto by those skilled in the art without departing from the basic concept and scope of the invention.

We claim:

1. An air-fuel ratio control device of an engine having an intake passage having a throttle valve therein, said device comprising:

first detecting means for detecting the degree of opening of the throttle valve;

second detecting means for detecting an actual absolute pressure in the intake passage downstream of the throttle valve;

memory means for storing a reference absolute pressure in the intake passage downstream of the throttle valve, said reference absolute pressure indicating a pressure produced when the engine is in a cruising state and being a function of the degree of opening of the throttle valve;

blunting means for calculating a blunt value of said actual absolute pressure; and control means for controlling an air-fuel mixture fed into the engine in response to the degree of opening of the throttle valve, to make said air-fuel mixture leaner when said blunt value of said actual absolute pressure becomes larger by a fixed value than said reference absolute pressure determined by the degree of opening of the throttle valve.

2. An air-fuel ratio control device according to claim 1, wherein said reference absolute pressure is also a function of an engine speed, and said control means makes said air-fuel mixture leaner when said blunt value of said actual absolute pressure becomes larger by said fixed value than said reference absolute pressure determined by both the degree of opening of the throttle valve and said engine speed.

3. An air-fuel ratio control device according to claim 1, wherein said blunt value follows said actual absolute pressure after a predetermined delay.

4. An air-fuel ratio control device according to claim 1, wherein said control means changes said air-fuel mixture from a mixture for the stoichiometric air-fuel ratio to a lean air-fuel mixture when said blunt value of said actual absolute pressure becomes larger by said fixed value than said reference absolute pressure determined by the degree of opening of the throttle valve.

5. An air-fuel ratio control device according to claim 1, wherein means for detecting an acceleration of the engine is provided, and said control means makes said air-fuel mixture leaner when said blunt value of said actual absolute pressure becomes larger by said fixed value than said reference absolute pressure determined by the degree of opening of the throttle valve after the acceleration of the engine is started.

6. An air-fuel ratio control device according to claim 1, wherein said fixed valve indicates a value which is a difference between said blunt value of said actual absolute pressure and said reference absolute pressure reaches during a time between a time at which a deceleration of an output torque of the engine begins to increase and a time at which said deceleration reaches a maximum value.

* * * * *